United States Patent [19]

Semple

[11] Patent Number: 4,530,318

[45] Date of Patent: Jul. 23, 1985

[54] INTAKE AND EXHAUST VALVE SYSTEM FOR INTERNAL COMBUSTION ENGINE

[75] Inventor: Harry F. Semple, Mt. Prospect, Ill.

[73] Assignee: Carol M. Semple, Elk Grove Village, Ill.

[21] Appl. No.: 572,250

[22] Filed: Jan. 20, 1984

[51] Int. Cl.[3] ..... F01L 1/34

[52] U.S. Cl. ..... 123/90.17; 123/90.24; 123/90.27; 123/90.31

[58] Field of Search ..... 123/90.15, 90.16, 90.17, 123/90.24, 90.27, 90.39, 90.44, 90.31

[56] References Cited

U.S. PATENT DOCUMENTS

| | | | |
|---|---|---|---|
| 1,265,799 | 5/1918 | McKechnie . | |
| 2,851,023 | 9/1958 | Durkan | 123/90.15 |
| 2,954,017 | 9/1960 | Forstner | 123/90 |
| 3,367,312 | 2/1968 | Jonsson . | |
| 3,413,965 | 12/1968 | Gavasso | 123/40.16 |
| 4,134,371 | 1/1979 | Hausknecht | 123/90.15 |
| 4,174,683 | 11/1979 | Vivian | 123/90.15 |
| 4,224,906 | 9/1980 | Happel | 123/90.15 |

FOREIGN PATENT DOCUMENTS 188717 11/1982 Japan ..... 123/90.15

OTHER PUBLICATIONS

"Variable Valve Timing", D. Scott, Popular Science, pp. 96–97, May 1980.

*Primary Examiner*—E. Rollins Cross

*Attorney, Agent, or Firm*—Lee, Smith & Zickert

[57] ABSTRACT

A system for controlling the timing of poppet-type intake and/or exhaust valves in internal combustion engines of the four-cycle spark or compression ignition and two-cycle compression ignition type that may be normally aspirated, supercharged or turbocharged, wherein the timing is adjusted automatically or manually in relation to the speed of the engine to obtain optimum efficiency at any given speed. Dual camshafts are utilized, one for opening the valves, and one for closing the valves. An adjustable timing mechanism between the crankshaft and the camshafts simultaneously adjusts the opening and closing cycles of the valves.

23 Claims, 30 Drawing Figures

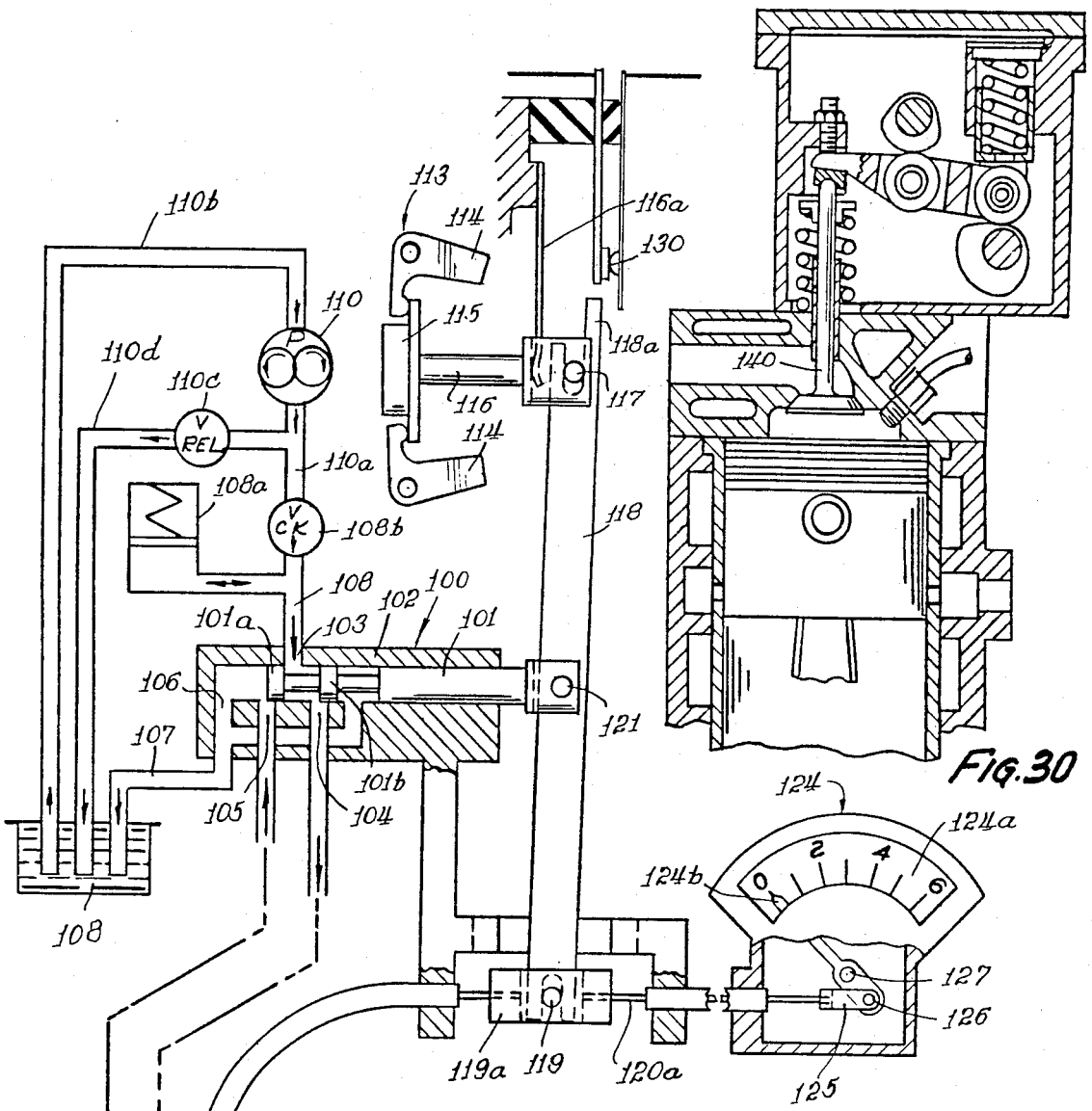
FIG. 30
FIG. 11
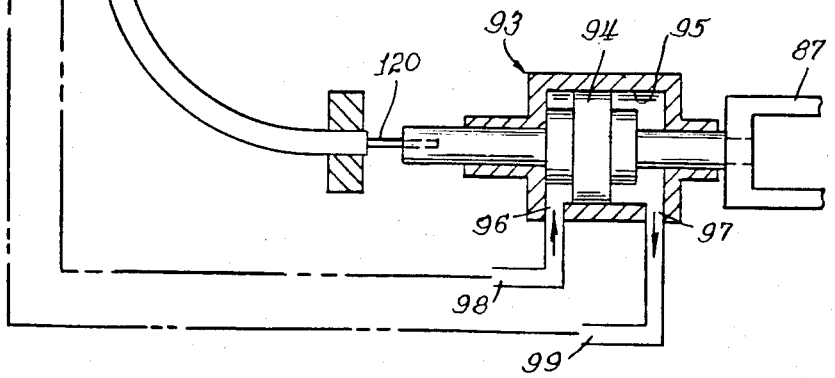

REFERENCE POINTS-
CAM DEGREES-0°
CLOSING
OPENING
INTAKE MIN. SPEED
CAM DEGREES-0°
REFERENCE POINTS-A
CRANKSHAFT DEGREES-0°
ENGINE CYCLE
PISTON POSITION -TDC
INTAKE
COMP.
POWER
EXHAUST
INTAKE MAX. SPEED

EXHAUST MIN. SPEED
EXHAUST MAX. SPEED
REFERENCE POINTS
CAM DEGREES-0°
CLOSING
OPENING
CAM DEGREES-0°
REFERENCE POINTS
CRANKSHAFT DEGREES-0°
ENGINE CYCLE
PISTON POSITION-TDC
INTAKE
COMP.
POWER
EXHAUST
TDC
BDC

CRANK DEGREES
0° @ TDC START OF
INTAKE STROKE

CAM 80°

CAM 30°

CAM 230°

CAM 55°

CAM 300°

INTAKE AND EXHAUST VALVE SYSTEM FOR INTERNAL COMBUSTION ENGINE

DESCRIPTION

This invention relates in general to an internal combustion engine, and more particularly to a system for controlling the timing of the intake and/or exhaust valves in relation to engine speed.

Heretofore, it has been well known to time the opening and closing of intake and exhaust valves for internal combustion engines of the four-cycle type and the exhaust valves of some two-cycles engines to provide optimum efficiency at one engine speed. Thus, engines are designed to produce optimum power output and fuel efficiency at only one speed. The usual mechanism employed for operating intake and exhaust valves includes a camshaft driven by the crankshaft in timed relation to the piston position in the cylinder to drive suitable lever means coacting with the valves. Thus, at the chosen optimum performance speed the valves are timed to provide optimum engine performance throughout the intake, compression, power and exhaust cycles. At any speed above or below that chosen speed, the timing of the opening and closing of the valves remains the same, thereby preventing the achievement of optimum power and fuel efficiency performance at other speeds. Thus, vehicles such as automobiles driven by internal combustion engines and by necessity needing the engine to run at various speeds to change the speed of the vehicle would operate at optimum performance at only the single given speed for which the engine is designed. Similarly, stationary engines desired to be run at multiple speeds would produce optimum performance at only one speed.

The present invention overcomes the heretofore known difficulties of obtaining optimum internal combustion engine performance at different speeds by providing a unique system for adjusting the timing of the intake and/or exhaust valves while the engine is running or not such that the engine will operate at optimum efficiency and performance at any speed chosen by the operator. The system may be operated manually or automatically. Thus, maximum power output and fuel efficiency is achieved by the present invention during any speed. An engine with the adjustable valve timing mechanism of the present invention will be able to idle at much lower speeds than conventional engines. Since most engines have a design speed much higher than idle, the present invention will materially increase fuel economy and decrease air pollution at idle speed and all other speeds except the design speed. Thus, the combustion gases in an engine of the present invention will burn cleaner.

More particularly the invention includes a mechanism for adjusting the timing of the opening and closing cycles of the intake and/or exhaust valves having a full floating valve operating lever means restricted against lateral and longitudinal movement and positioned vertically by two camshafts, the valve return spring and a lever means return spring.

It is therefore an object of the present invention to provide a new and improved internal combustion engine that is capable of operating at optimum efficiency at any given speed.

Another object of the present invention is in the provision of a system for manually or automatically adjusting the timing of the intake and/or exhaust valves in an internal combustion engine in relation to the speed of the engine to obtain optimum performance at all speeds.

A further object of this invention is to provide a mechanism for adjusting the timing of the opening and closing cycles of the intake and/or exhaust valves having a full floating valve operating lever means restricted against lateral and longitudinal movement and postioned vertically by two camshafts, the valve return spring and a lever means return spring.

Other objects, features and advantages of the invention will be apparent from the following detailed disclosure, taken in conjunction with the accompanying sheets of drawings, wherein like reference numerals refer to like parts, in which:

FIG. 11 is a schematic diagram of the hydromechanical closed loop servo system for adjusting the valve timing;

Figures 12, 13, 14, 15, 16, 17:
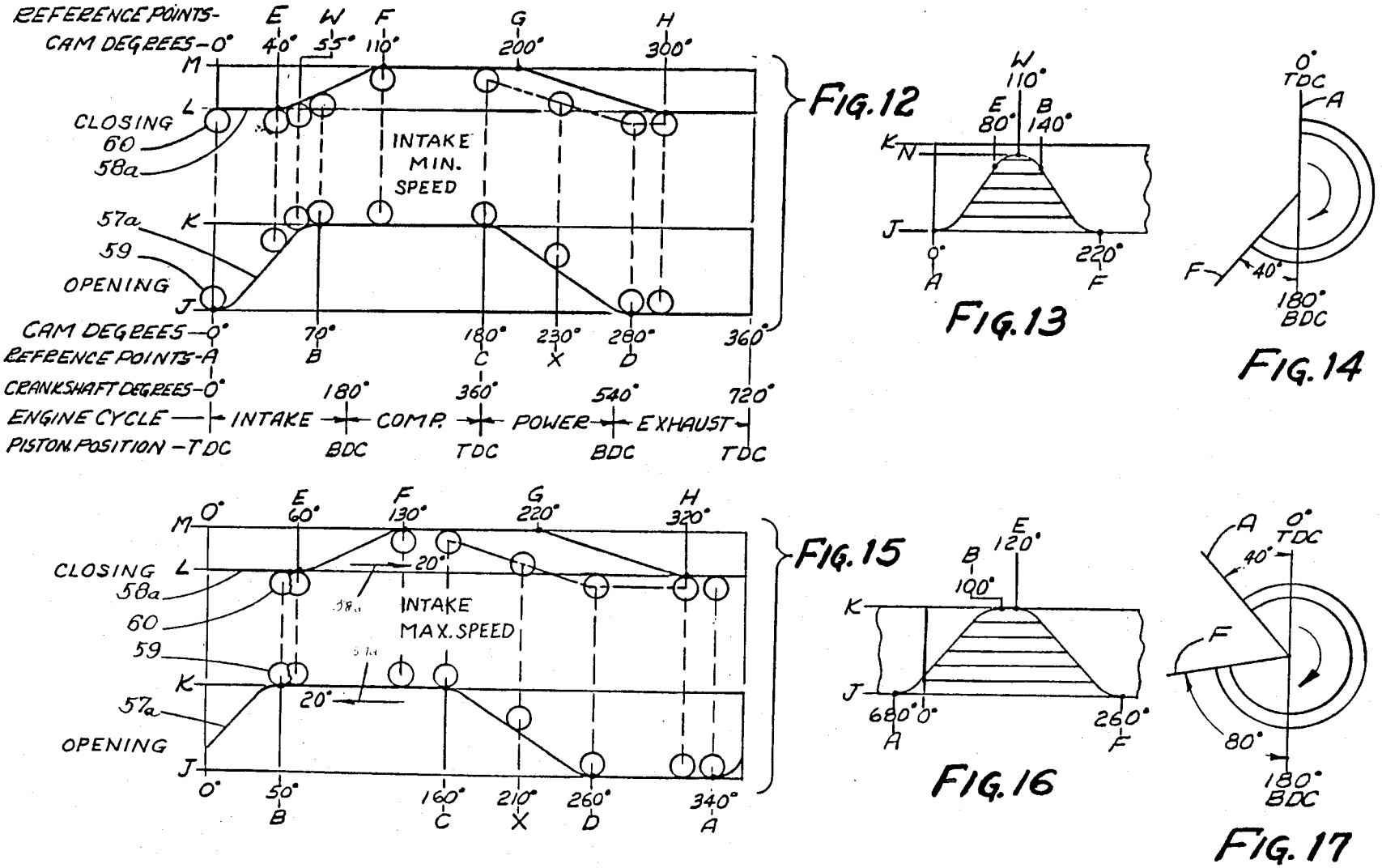
FIG. 12 is a cam timing diagram for the closing and opening camshafts of the intake valve for the minimum engine speed condition and where the valve opening camshaft is fully retarded and the valve closing camshaft is fully advanced.
FIG. 13 is a graphical illustration of the intake valve open duration and lift in crankshaft degrees for the minimum engine speed condition of FIG. 12.
FIG. 14 is a valve timing diagram illustrating the relation between the intake valve open cycle and the position of the piston in the cylinder for minimum engine speed.
FIGS. 15, 16 and 17 are views similar to FIGS. 12, 13 and 14 for the intake valve when the engine is operating at maximum speed, thereby illustrating the fully advanced position of the opening camshaft and the fully retarded position of the closing camshaft.

FIGS. 24 to 29 are schematic views showing the sequential operation of an intake valve when it is opened and closed during a cycle of operation with cam reference points indicated which correspond to those designated on the camshaft timing diagram of FIGS. 12 and respectively showing camshaft positions of 0°, 30°, 55°, 80°, 230° and 300°; and FIG. 30 is a sectional view taken through a compression ignition engine having the full floating rocker lever of the invention and the cams for controlling lever movement to operate the poppet-type exhaust valve.

Figure 9:
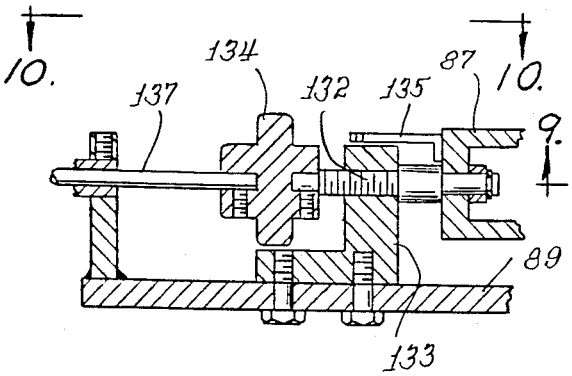
FIG. 9 is a sectional view taken along line 9—9 of FIG. 10 through a manual adjusting mechanism for the camshaft timing system.
Figure 10:
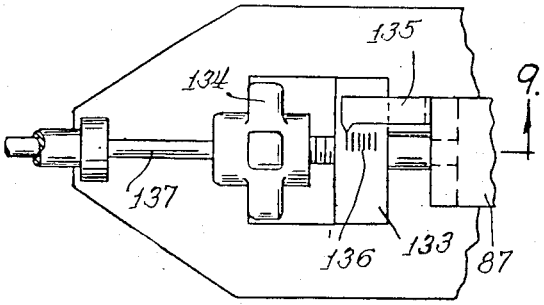
FIG. 10 is a top plan view of the mechanism shown in FIG. 9 and taken in the direction of the arrows 10—10.

Referring now to the drawings, and particularly to FIGS. 1 to 8 and 11, for simplicity a single cylinder engine is illustrated to describe the invention, although it should be appreciated that the invention, which is a system for controlling and adjusting the timing of the opening and closing cycles of the intake and exhaust valves in a four-cycle internal combustion engine, and the exhaust valves of some two-cycle engines, the invention may equally well apply to a multi-cylinder engine. It should be further understood that the embodiment illustrated in these figures provides a system for automatically adjusting the valve cycle timing during engine operation, while a system for manually adjusting the timing during engine operation or when the engine is not running is illustrated in FIGS. 9 and 10.

The engine includes an engine block 32 having a cylinder 33 within which a piston 34 is slidably received. The piston is connected to a crankshaft 35 by a connecting rod 36 and wrist pin 36*a* in the usual manner. Suitable bearings in the block 32 rotatably mount the crankshaft 35 and, as seen particularly in FIG. 3, a flywheel 37 is mounted on one end of the crankshaft and disposed outside the block, while a valve timing pulley or gear 38 is mounted on the other end and disposed outside of the block. The flywheel 37 would be connectable to suitable driven members and in the case of an automobile to a transmission that would in turn be drivingly connected to wheels of the automobile.

The engine further includes a cylinder head 42 suitably secured to the block and provided with a combustion chamber 43 which coacts with the head of the piston 34 in a well known manner. A spark plug 44 is mounted in the head 42 for purposes of producing ignition for a combustible charge in the combustion chamber 43, although such would be replaced by a fuel injector nozzle in a compression ignition engine.

An intake valve 47 and an exhaust valve 48 are reciprocably mounted in the head 42 and respectively in communication with intake and exhaust ports 49 and 50 on one side and the combustion chamber 43 on the other side for respectively controlling the feeding of a combustible fuel-air mixture to the combustion chamber and exhausting combustion gases from chamber. For purposes of explaining the invention, as seen particularly in FIG. 3, the intake port is designated as 49 and the exhaust port as 50. The intake port would be connectable to a fuel-air mixing device and the exhaust port would be connected to the ambient. It should be further appreciated that the engine may be of the fuel injected type where fuel is injected directly into the combustion chamber where the intake valve would merely control the introduction of air to the chamber.

Figures 1, 2:
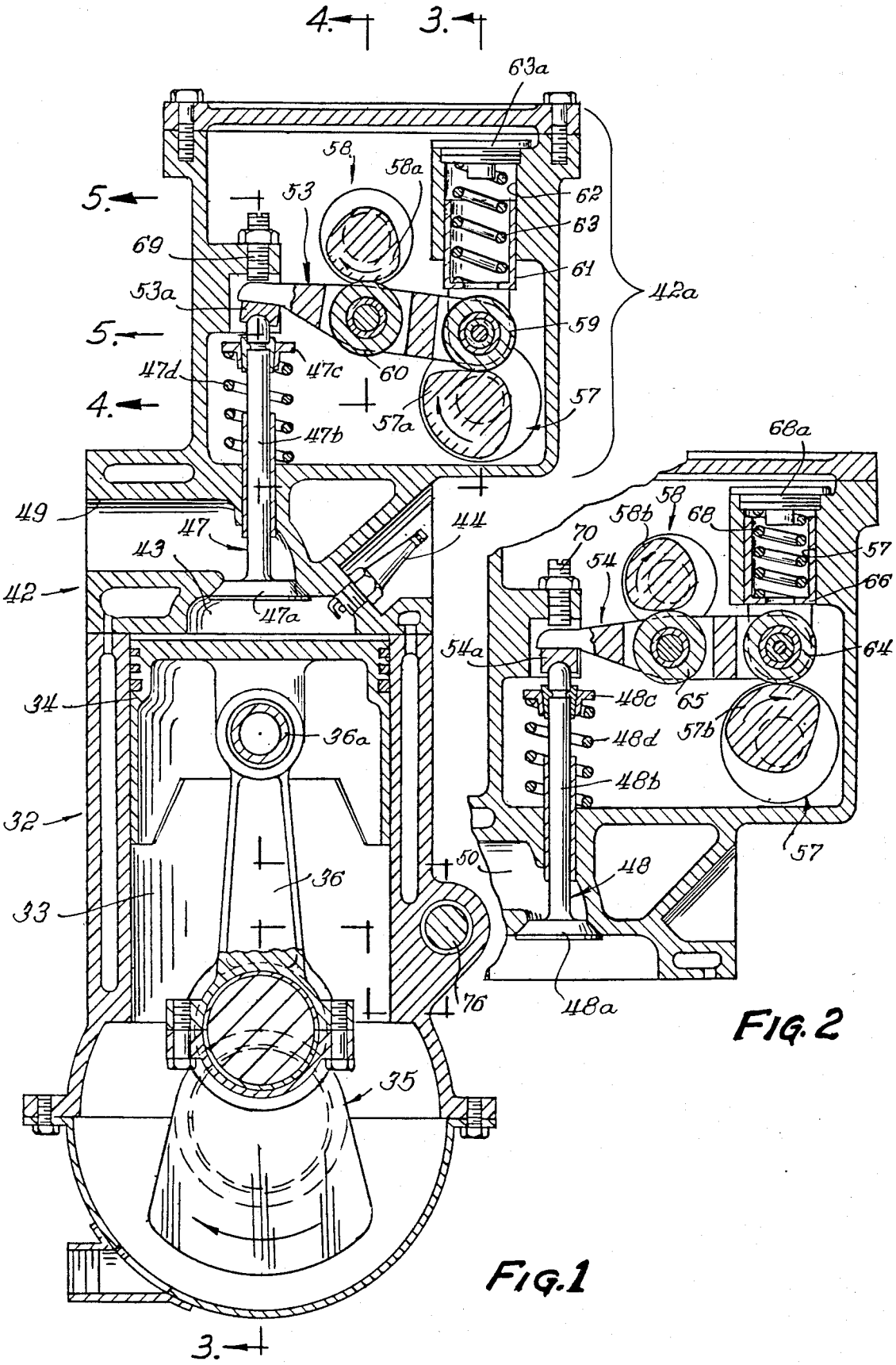
FIG. 1 is a front transverse sectional view taken through the internal combustion engine of the present invention along the area of a cylinder and the intake valve and generally along line 1—1 of FIG. 3 and showing the valve opening and closing camshafts.
FIG. 2 is a fragmentary front elevational and transverse sectional view similar to FIG. 1 but illustrating the exhaust valve for the same cylinder shown in FIG. 1 and taken generally along line 2—2 of FIG. 3.
Figure 3:
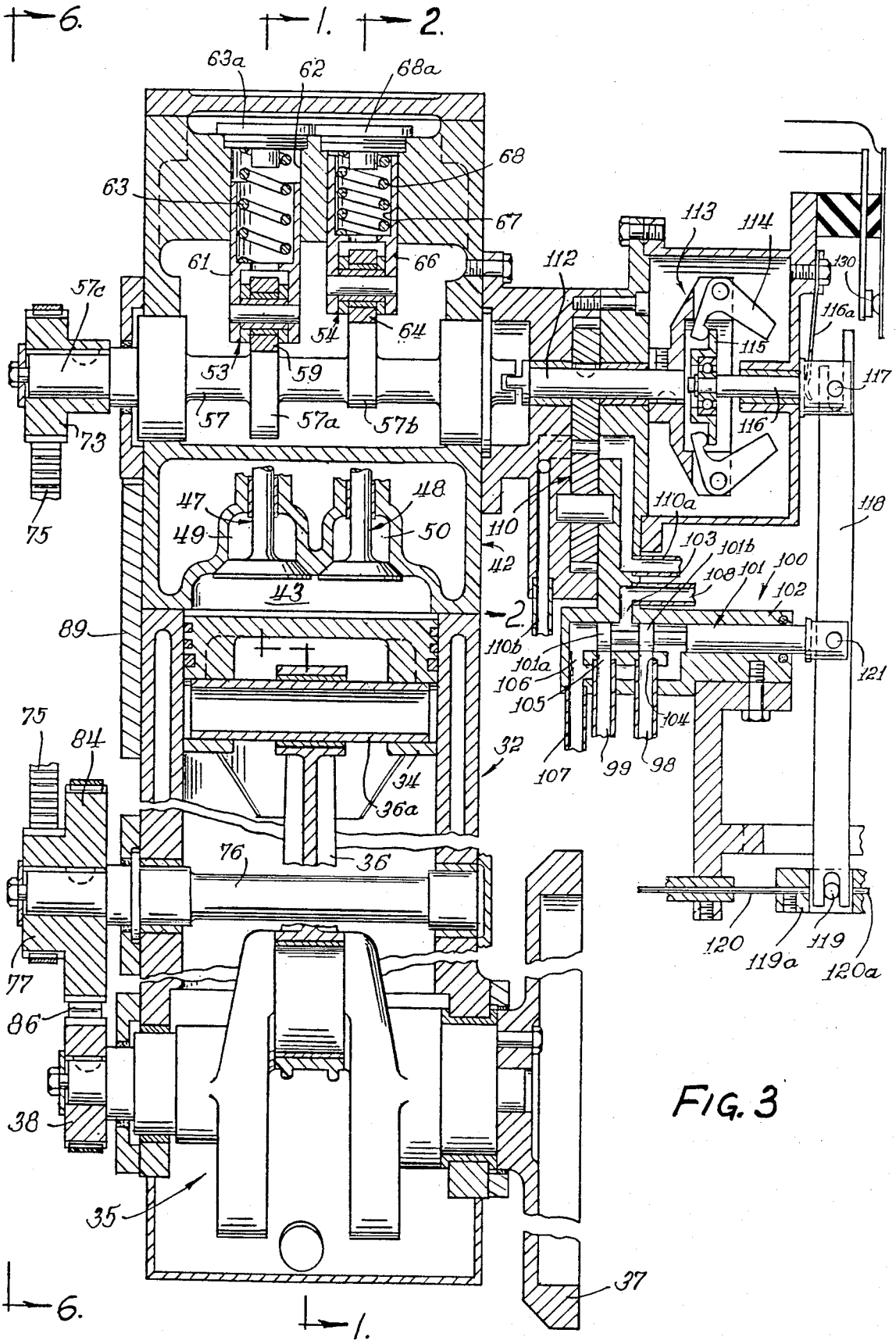
FIG. 3 is a longitudinal sectional view taken through the engine of the present invention and showing a part of the speed control mechanism that automatically controls the timing of the valves in relation to engine speed and taken generally along line 3—3 of FIG. 1 and showing the valve opening camshaft.

The intake and exhaust valves respectively include valve heads 47*a* and 48*a*, valve stems 47*b* and 48*b*, and have mounted at their free ends spring retaning collars 47*c* and 48*c* for valve return springs 47*d* and 48*d* which continually urge the valves into closed and seated positions as shown in FIGS. 1, 2 and 3, and also the stems thereof into engagement with rocker levers which will be further described.

The opening and closing cycles of the valves are controlled by dual camshafts controlling the positions of the full floating valve operating rocker levers that are restricted against lateral and longitudinal movement but which are positioned vertically by the camshafts to corrdinate and control the opening and closing cycles of the valves. The camshafts are driven by the crankshaft at one-half crankshaft speed. Movement of the rocker levers is also dependent upon the valve return springs and rocker return springs.

The valve operating rocker levers and the camshafts are mounted in a suitable cam carrier designated 42A which, while shown in the drawing to be constructed integrally with the head, may be made as a separate section mountable on the head, as shown in FIG. 30. A rocker lever 53 is associated with the intake valve 47, while a rocker lever 54 is associated with the exhaust valve 48. For driving the rocker levers a valve opening camshaft 57 coacts with one part of the lever, while a valve closing camshaft 58 coacts with another part of the lever. While the rocker lever is illustrated as being a single member, it may be appreciated that it could be made in two parts where one camshaft would operate against one part and another camshaft against another part and the two parts themselves being interengaging so that the proper motion can be transmitted to the valves during the opening and closing cycles.

Figure 5:
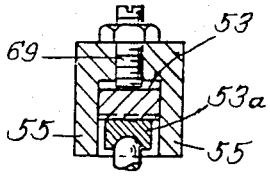
FIG. 5 is a detailed sectional view taken substantially along line 5—5 of FIG. 1 and showing the side guides and detent screw for a valve operating rocker lever.

A valve stem lash adjuster 53*a* is disposed between the nose and the end of rocker lever 53 and the free end of the intake valve stem 47*b* to provide the desired valve clearance and also to function to transmit the force from the rocker lever to the valve stem. The top of the lash adjuster has a sliding engagement with the nose end of the rocker lever and is restrained laterally and longitudinally by the spherical end of the valve stem engaging a spherical recess in the bottom side of the adjuster. Similarly, a valve stem lash adjuster 54*a* is provided between the nose end of the exhaust valve rocker lever 54 and the free end of the exhaust valve stem 48*b*. The nose end of the rocker levers is restrained against lateral movement by guide members mounted on the cam carrier. With reference to FIG. 5, guide members 55 restrain the nose end of rocker lever 54 against lateral movement and guide the vertical movement of the nose and of the lever during the opening and closing cycles of the valve. Similarly, the nose end of rocker lever 54 is guided against lateral movement. While the guide members 55 are illustrated as being integral with the cam carrier housing, it will be appreciated that they can be separately constructed and then mounted to the housing.

The cam follower 59 in the form of a roller is mounted on the rocker lever 53 at the end opposite the nose and for engagement with an opening cam lobe 57*a* on the opening camshaft. A cam follower 60 in the form of a roller is mounted intermediate the ends of the rocker lever 53 and engageable with a closing cam lobe 58*a* on the closing camshaft 58. The cam follower 59 is spring biased into continuous engagement with the cam 57*a* by means of a rocker lever locater 61 pivotally connected to the rocker lever on the same axis as the cam follower 59 and slidably received in a bore 62 of a fitting formed on the interior of the cam carrier housing. A rocker return spring 63 is received within the tubular rocker locator 61 and bottomed at one end on the locator and at the other end on a retainer 63*a* mountable at the upper end of the bore 62. The rocker locater 61 functions to restrain the rocker lever 53 against longitudinal movement and the tail end of the lever which includes the follower 59 against lateral movement. Thus, the rocker lever 53 is restrained against both lateral and longitudinal movement by the guide members 55 at the nose end of the lever and by the rocker locater 61 at the tail end of the lever and controlled during vertical movement and rocking movement by the opening and closing camshafts. Accordingly, the rocker lever functions as a full floating valve operating member for controlling the operation of the intake valve.

Similarly, the exhaust valve rocker lever 54 is a full floating valve operating lever. As already mentioned, the nose end is restricted against lateral movement by guide members in the same fashion as rocker lever 54 and the tail end of lever 54 is restricted against lateral and longitudinal movement by a rocker lever locator 66 pivotally connected at its lower end to the tail end of the lever 54 and on the same axis as the cam follower 64 and slidably received in a bore 67 of a fitting formed on the interior of the cam carrier housing. A rocker return spring 68 is disposed and bottomed at one end on the locater and at the other end by a retainer 68*a* mounted at the upper end of bore 67. This locater and spring arrangement maintains the cam follower 64 in continual engagement with the opening cam lobe 57*b* on the opening camshaft 57. While the rocker locators 61 and 66 are axially aligned with and pivotally connected to the same axis as the opening cam followers 59 and 64, it should be appreciated that they could be offset from the cam followers along the rocker lever or even in alignment with the closing cam follower. In either location along the rocker lever the locator will function to prevent lateral and longitudinal movement of the rocker lever and also coact with the guide members at the nose end of the rocker lever to prevent lateral movement. Because the rocker lever is floating and directionally positioned by two camshafts during valve opening and closing, the fulcrum is movable longitudinally therealong from an intermediate position to one end and then the other end such that the lever functions as first, second and third class levers during its operation.

Figure 29:
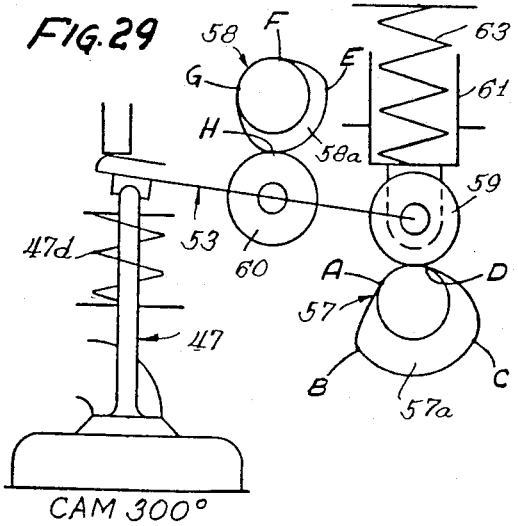

It will be appreciated that the rocker levers likewise move in a rocking and up-and-down fashion, and it is therefore important to prevent damage to them and the closing cams which could occur on the reset cycles of the rocker levers and closing cams. Accordingly, stop or limit screws 69 and 70 are mounted on the nose guides to prevent such upward movement of the nose ends of the rocker levers that would damage the cams or the cam followers. These screws are adjustable and are adjusted such that there is a slight clearance between the screws and the lever when the valves are in closed position, during the low dwell of the open cam lobe and the high dwell of the close cam lobe, as illustrated in FIGS. 1, 24 and 29.

It may now be appreciated that the opening and closing cycles of each valve are dependent upon movement of the full floating valve operating rocker lever as it is positionally controlled by the cams on the opening and closing camshafts in coaction with the valve return spring and the rocker return spring. Intake and exhaust valves will obviously open and close at different times although the mechanism for effecting the opening and closing operates in the same manner for each valve.

Figure 24:
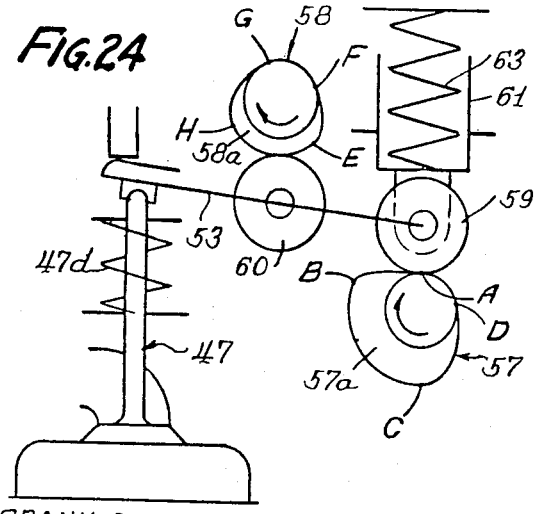

Illustrations showing the opening and closing cycles of the intake valve at minimum engine speed are shown in FIGS. 24 to 29. The lettered reference points in these figures correspond to those in FIG. 12. FIG. 24 depicts the position of the parts at zero crankshaft degrees, zero cam degrees and top dead center at the beginning of the intake stroke.

Figure 27:
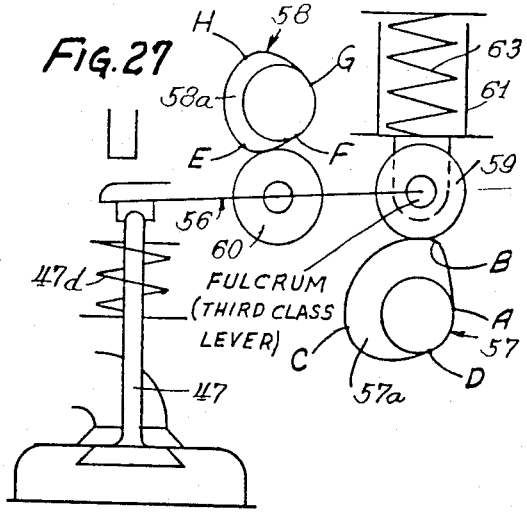
Figure 25:
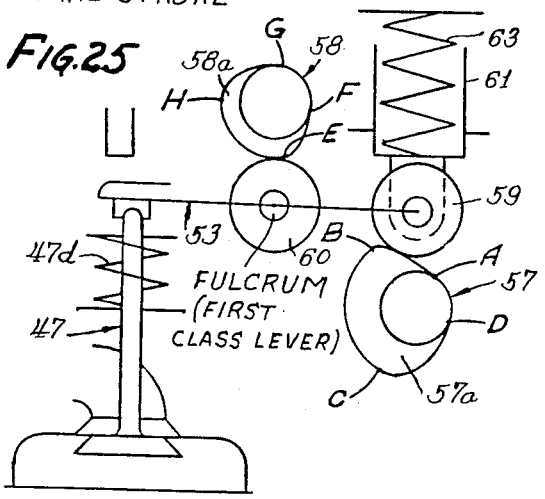
Figure 28:
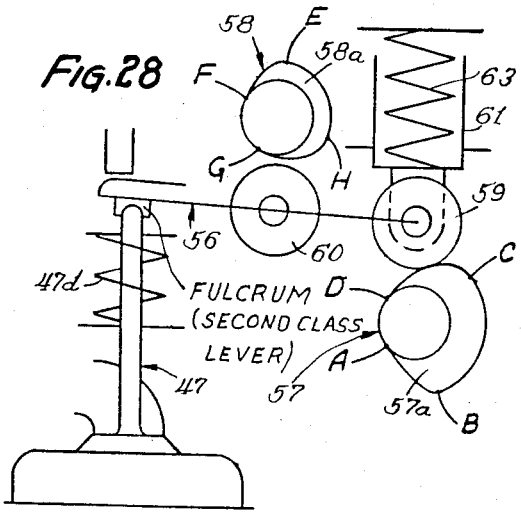
Figure 26:
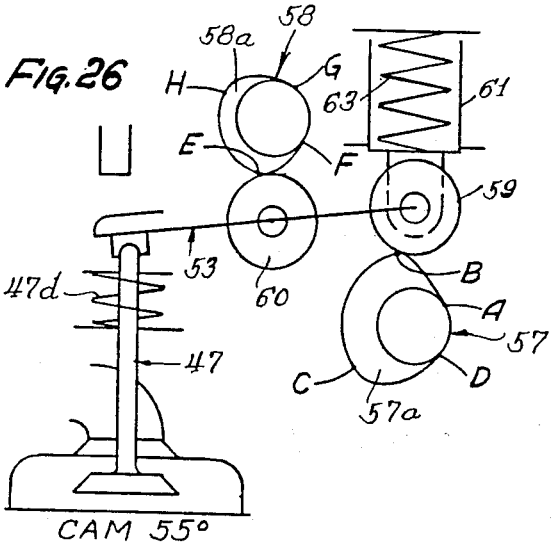

FIGS. 25 and 26 show the opening cycle of the intake valve 47 at which time the rocker lever 53 functions as a first-class lever where the fulcrum of the lever is at the axis of the closing cam roller 60. The crankshaft is at the 60 degree position and the camshaft at 30 degrees in FIG. 25, and in FIG. 26 the crankshaft is at 110 degrees while the camshaft is at 55 degrees. Moreover, the rocker lever is shown functioning as a walking beam in FIG. 26. The fulcrum for the rocker lever 53 moves to the axis of the opening cam follower 59 as shown in FIG. 27 during the beginning of the closing stroke of the valve and wherein the rocker lever functions as a third-class lever. The crankshaft is at the 160 degree position and the camshaft at 80 degrees in FIG. 27. As the crankshaft continues to rotate, the closing cam disengages from the closing cam follower, and at the 460 degree position of the crankshaft and the 230 degree position of the camshaft, as shown in FIG. 28, the fulcrum on the lever shifts to the free end of the valve 47 at which time the lever functions as a second-class lever. The crankshaft position of 600 degrees and the camshaft position of 300 degrees is illustrated in FIG. 29 where the closing cam resets itself over the closing cam follower 60 and prepares the valve for a subsequent opening stroke as depicted in FIG. 24. Just prior to the position shown in FIG. 28, the closing cam has allowed the valve return spring to close the valve and at this point when the rocker lever functions as a second-class lever, the opening cam has allowed the rocker return spring to reset the rocker lever to the position shown in FIG. 29.

Figure 4:
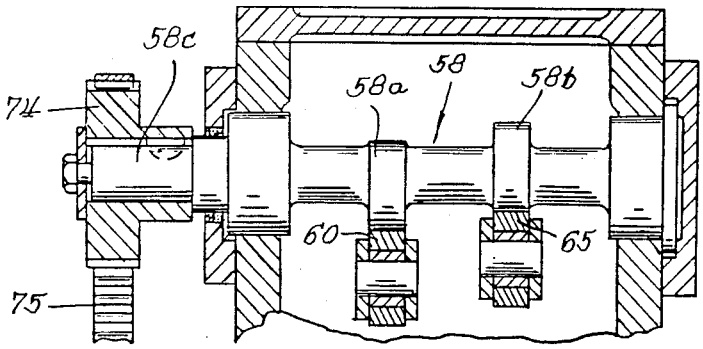
FIG. 4 is a fragmentary sectional view taken through the valve operating section of the engine and generally along line 4—4 of FIG. 1 and showing the valve closing camshaft.

As seen particularly in FIGS. 3 and 4, the camshafts 57 and 58 are transversely mounted in parallel relation to each other in the cam carrier 42A and respectively include stub shaft portions 57*c* and 58*c* on which are respectively mounted belt pulleys 73 and 74 that are driven by a timing belt 75 from a speed reducing shaft 76 that is in turn connected to the crankshaft 35. As seen particularly in FIG. 6, the timing belt 75, in addition to being trained over the camshaft belt pulleys 73 and 74, is trained over belt pulley 77 on the speed reducing shaft and a series of three interacting movable pulleys 81, 82 and 83 that, as will be more particularly described, function to change the timing of the opening and closing camshafts 57 and 58. The pulley 81 may be referred to as a timing pulley, while the pulleys 82 and 83 may be referred to as takeup pulleys. A planetary gear drive system may be used in place of the pulley system to advance and retard the camshafts. A second belt pulley 84 is mounted on the speed reducing shaft 76 and of a much larger diameter than the pulley 77 and is in driving relation with a crankshaft belt pulley 38 through a driving belt 86 to establish a two-to-one speed ratio between the crankshaft and the camshafts. Thus, the opening and closing camshafts 57 and 58 are driven at a timed speed relative to the crankshaft 35 through a timing belt and pulley system. For every revolution of the crankshaft, each camshaft makes one-half revolution.

The timing of the camshafts 57 and 58 is adjusted by movement of the carriage 87 on which the timing adjustment belt pulley 81 is mounted and which also includes a pin 88 slidably received in bifurcated ends of pulley mounting levers 82*a* and 83*a* for belt takeup pulleys 82 and 83 respectively. The levers 82*a* and 83*a* are respectively pivotally mounted on fixed pins 82*b* and 83*b* extending from a mounting plate 89 secured to the engine. The pulleys 82 and 83 are mounted on the ends of levers opposite the bifurcated ends which engage the pin 88 on the carriage 87. Thus, movement of the carriage 87 which is bearingly mounted at one end by bearing 90 and bearingly mounted at the other end by a bearing 91 of a servomotor will cause respective movement of the pulleys 81, 82 and 83 that will maintain the take-up of the timing belt 75 and will adjust the timing of the camshafts 57 and 58 and respectively the timing of the opening and closing cycles of the intake and exhaust valves in relation to crankshaft and piston position. When the carriage 87 moves toward the bearing 90, camshaft 57 is advanced and camshaft 58 is retarded. Movement in the opposite direction causes the opposite action for the camshafts.

Figure 6:
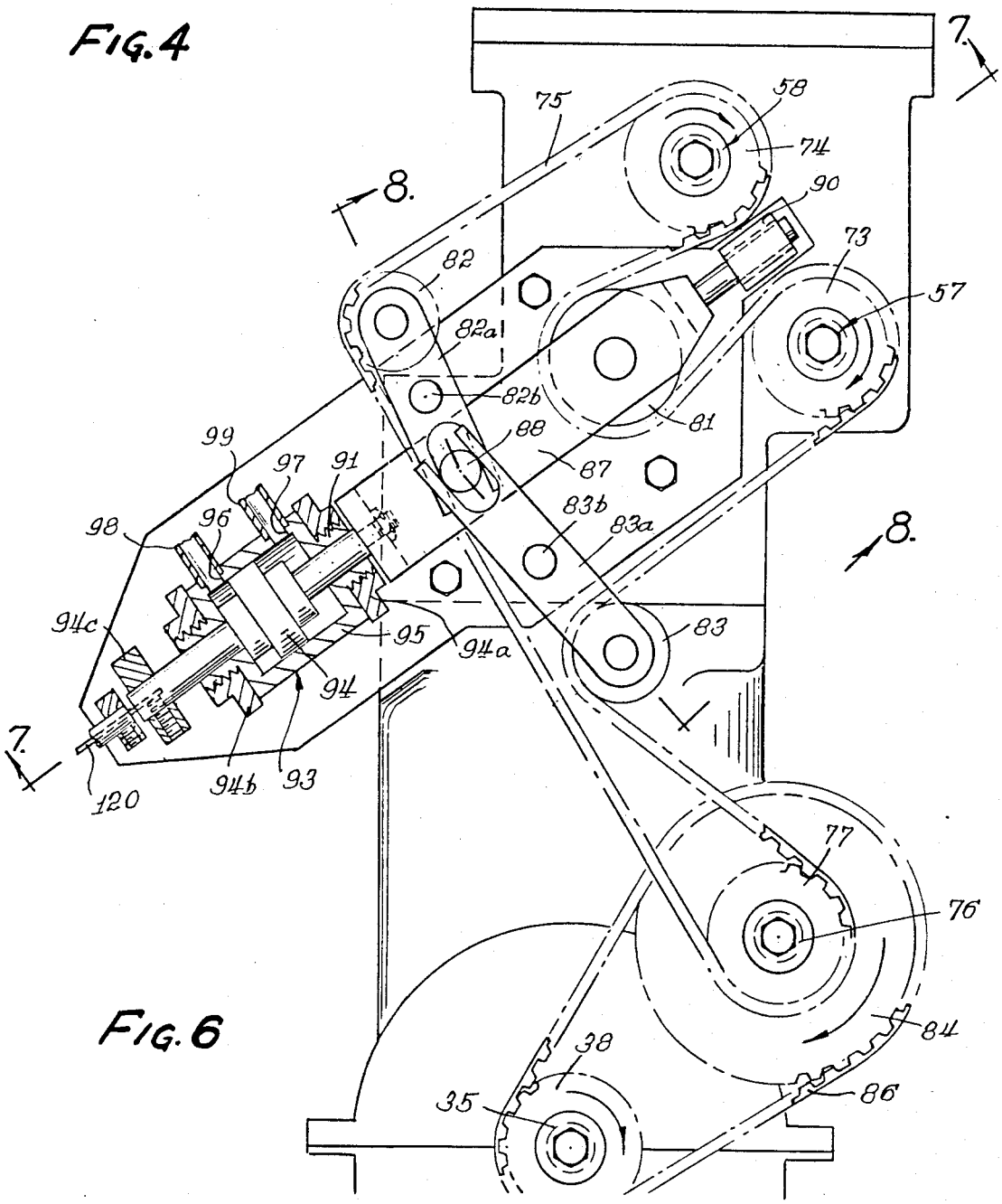
FIG. 6 is a front elevational view of the engine taken along line 6—6 of FIG. 3 and showing the servomotor and drive mechanism for the camshafts for adjusting the timing of the camshafts and the parts in the position of minimum engine speed.

As also seen particularly in FIG. 6, a hydraulic servomotor 93, mounted on plate 89, is connected to the carriage 87 for effecting movement of the carriage. The servomotor 93 includes a piston 94 movable in a cylinder 95 having ports 96 and 97 connected to hydraulic lines 98 and 99 that are in turn connected to a four-way control valve 100, as schematically seen in FIG. 11. FIG. 11 illustrates a complete hydro-mechanical closed loop servo system.

The control valve 100 includes a movable piston 101 in a housing 102 having a high pressure inlet port 103. Outlet ports 104 and 105 respectively are connected to hydraulic lines 98 and 99 and a low-pressure return port 106 is connected to a return line 107 that communicates with a reservoir 108. The inlet port 103 is connected to a high pressure line 108 that is connected in common to an accumulator 108*a* and the high pressure discharge line 110*a* which is in turn connected to the high pressure discharge side of the positive displacement hydraulic pump 110. A check valve 108*b* holds pressure in the accumulator. The accumulator when charged permits the manual operation of the system when the engine is not running. The low pressure intake side of the pump is connected to a low pressure suction line 110*b* that is connected to the reservoir. A relief valve 110*c* in a pressure relief line 110*d* limits the pressure at the discharge side of the pump 110.

The hydraulic pump 110 includes a drive shaft 112 that is coupled to and driven by the valve opening camshaft 57, as seen particularly in FIG. 3. The drive shaft 112 of the pump also has connected at the other end a centrifugal speed responsive mechanism 113 having a plurality of weighted levers 114 which, in response to increasing speed through centrifugal action, drive a collar 115 having a reciprocably mounted shaft 116 connected thereto. It should be appreciated that the pump 110 and/or the mechanism 113 may be driven from any other rotating part of the engine and located elsewhere than illustrated. A leaf spring 116*a* applies a continuing bias force to the shaft 116 to urge it in the position shown in FIG. 3 in the direction of the drive shaft 112. The outer end of the shaft includes a yoke and drive pin 117 receiving the upper bifurcated end of a drive lever 118. The lower end of the lever 118 is bifurcated and engages a feedback pin 119 carried by an anchor block 119*a* that is connected to a feedback push pull cable 120 which is movable in response to the position of the piston 94 in the hydraulic servomotor, as can be best seen in FIG. 11. Intermediate the ends of the lever 118, the drive end of the piston 101 is pivotally connected at 121. The piston 101 includes lands 101*a* and 101*b* which upon movement of the piston control the communication between the ports of the valve. In the position illustrated in FIG. 3, the outlet ports 104 and 105 are closed, thereby preventing movement of the servomotor and maintaining it in a given position.

The speed responsive mechanism for automatically adjusting the opening and closing cycles of the valves also includes a valve timing indicator 124 (FIG. 11) which indicates the valve timing condition of the engine and is converted to engine RPM. Thus, it indicates the position of the timing belt carriage 87 which reads out on a scale 124*a* the revolutions per minute (R.P.M.) of the engine crankshaft in accordance with the position of the indicating needle 124*b*. The position of the indicating needle 124*b* is directly responsive to the movement of a push pull speed indicator cable 120A which is connected to the anchor block 119*a*. The cable 120A extends into the speed indicator 124 and is connected to a clevis 125 pivotally connected by a pin 126 to the end of the indicating needle 124*b* on the side of the pivot pin 127 opposite the indicating portion which moves relative to the scale 124*a*. As the drive lever 118 moves in response to the speed responsive mechanism 113 to drive the control valve piston 101 to a position for actuating the servomotor, movement of the servomotor piston, in turn, causes movement of the feedback cable 120 which moves the feedback pin 119 of the drive lever 118 to bring the control valve piston 101 to a position that stabilizes the servomotor operation and holds the servomotor piston in the newly set position. Thus, initial actuation of lever 118 by mechanism 113 opens the control valve 100 to operate the servomotor and drive the timing carriage 87, followed by the servomotor driving the feedback cable and closing the control valve to maintain the new position of the carriage and the new timing. At the same time, the speed indicator cable 120A drives the speed indicator 124 to indicate the R.P.M. of the engine. The speed indicator 124, if used in conjunction with an engine driven tachometer, will indicate a servo system malfunction if the readouts do not correspond. It should be recognized that the servo system may be hydroelectric with appropriate electronic controls and a feedback potentiometer operated by the servomotor.

In the event that the speed of the engine is increased beyond a predetermined speed, which might cause damage to the engine, the drive lever 118 would be driven beyond a predetermined point. The upper end of the lever includes an extension 118*a* which will then engage the resilient arm of a shutoff switch 130 connected in the ignition of the engine to open the switch and de-energize the ignition or the fuel shutoff valve for a compression ignition engine, thereby shutting the engine down until the engine RPM slows to the predetermined speed and closes the switch. It should be appreciated that other forms of speed limitation systems may be used to limit maximum speed.

The opening and closing cycles of both the intake and exhaust valves are simultaneously adjusted by the adjustable valve timing mechanism of the invention relative to the speed of the engine during engine operation. Thus, a change in engine speed will cause a proportional change in the timing of the opening and closing cycles of the valves. This timing change modifies the valve open duration by changing the points of opening and closing and also the valve lift which is a measure of the opening created by the valve during a valve opening cycle. While the cam and valve timing is shown to be balanced, it should be appreciated that it may be unbalanced if desired. Thus, each cam may be advanced or retarded individually or both at an unequal ratio.

The opening camshaft is in the fully retarded position and the closing camshaft is in the fully advanced position during minimum engine speed, as seen in FIGS. 1 to 4, 6, 7, 9, 10, 12 to 14, 18 to 20, and 24 to 29. For maximum engine speed the opening camshaft is in the fully advanced position of 20 degrees as indicated by arrow 57*d*, and the closing camshaft is in the fully retarded position of 20 degrees as indicated by arrow 58*d*, as seen in FIGS. 15 to 17 and 21 to 23.

Figures 18, 19, 20, 21, 22, 23:
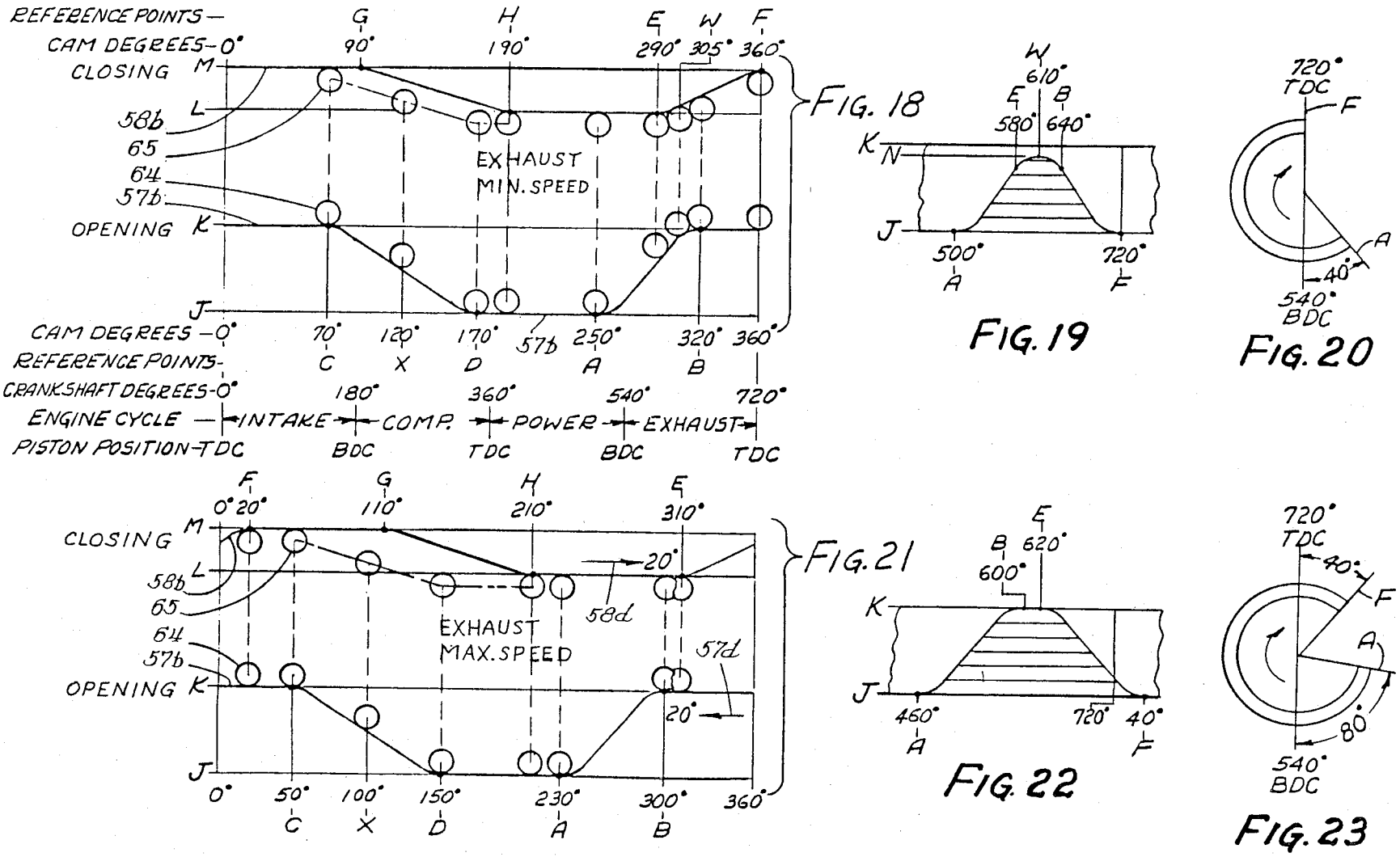
FIGS. 18, 19 and 20 are similar to FIGS. 12, 13 and 14 except that they relate to the operation of the exhaust valve during minimum engine speed.
FIGS. 21, 22 and 23 are similar to FIGS. 15, 16 and 17 except that they relate to the operation of the exhaust valve when the engine is operated at maximum speed.

In order to more clearly understand the operation of the present invention during minimum engine speed, reference is now made to the valve diagrams of FIGS. 12 to 14 and FIGS. 24 to 29 which illustrate the relationship between the crankshaft, camshafts and valve positions for the intake valve, and FIGS. 18 to 20 for the exhaust valve. The cam timing diagram of FIG. 12 illustrates the positions of the closing and opening camshafts relative to the position of the crankshaft all in degrees where the timing of the closing camshaft 58 is illustrated along the upper cam line 58A and the timing of the opening camshaft is located along the lower cam line 57*a* for the intake valve. FIG. 18 shows the respective positions for exhaust valve cams 58*b* and 57*b*. The timing illustrated in FIGS. 12 and 18 for the valves is such as to provide maximum efficiency for the engine operating at low speed or the minimum speed of the engine.

More particularly, the opening cycle of the valve begins at a zero degree crankshaft and camshaft or top dead center (TDC) position and closes at the 220 degree crankshaft and 110 degree camshaft position which covers all of the intake cycle and a part of the beginning of the compression cycle. During this timing relationship the valve does not open into fully open position, as shown in FIG. 13, but only to position N at the 110 degree position of the crankshaft and which is equivalent to the 55 degree position (W) of the camshaft, as seen in FIG. 12.

At the position of the cam followers designated by reference point A in FIG. 12, the intake valve is in fully closed position as illustrated in FIG. 24. The reference points on the parts in FIGS. 24 to 29 correspond to like designated reference points in FIG. 12, and the arrows in FIGS. 24 to 29 indicate motion. As the camshafts rotate to position E (40 degrees camshaft rotation), cam follower 59 moves up the rise of opening cam 57*a*, while the closing cam follower 60 remains in the same position, and which causes partial opening of the intake valve. This partial opening is illustrated in FIG. 25, although the parts are in the 30 degree camshaft position, and at this time the rocker lever functions as a first-class lever with the fulcrum at follower 60. Rotation of the camshafts to the cam followers reference point position W causes the closing cam follower 60 to move down the lobe as the opening cam follower 59 continues to move up the rise to its maximum point on the opening cam 57*a*. This 55 degree camshaft position is illustrated in FIG. 26, where the valve is in the highest lift position for minimum engine speed. Between 40 degrees and 70 degrees camshaft positions, "cam underlap" is present where both cams are moving the rocker lever 53 causing it to move as a walking beam in the direction of the arrows, and also causing closing action for the valve. The term "cam underlap" and as below used the term "cam overlap" are new and only possible with the present invention where a floating rocker lever is provided. Cam overlap occurs when both cams are engaging the lever with the high dwell and which cause the valve to be fully open for a segment of camshaft rotation. Heretofore, it has been known to have "valve overlap" when both valves are at least partially open as illustrated herein during maximum speed condition, but cam underlap and overlap are unique to the present invention. The floating rocker lever allows the cam underlap action, and the valve lift is thereby reduced. The reduced valve lift at lower speeds increases the velocity of the gas and/or air entering the combustion chamber to increase turbulence and enhance combustion. As soon as the closing cam retards 15 degrees and the opening cam advances 15 degrees with increased speed, underlap disappears. In the event that underlap is not desired, the system could be designed accordingly. The opening follower 59 is riding on the high dwell of opening cam 57*a* at reference point position B, while the closing cam follower 60 is moving down the closing cam lobe 58*a* to allow the closing of the intake valve. FIG. 27 shows the parts in 80 degree camshaft position as the valve is partially closed and where the rocker 53 functions as a third-class lever with the fulcrum at the opening cam follower. At the 110 degree position of the camshafts and the 220 degree position of the crankshaft shown at reference point position F, the closing cam follower reaches the low dwell of the closing cam 58*a* to permit the complete closing of the intake valve. At top dead center or 180 degrees rotation of the camshafts, the opening cam follower reaches the end of the high dwell of opening cam 57*a* as noted at reference point position C, while the closing cam follower continues at the same level of cam 58*a*. From that point until the camshafts reach the 300 degree position, the closing cam follower 60 is out of engagement with the closing cam 58*a* as noted by the dotted line path of cam folower 60 between the reference point positions C and H. It is during this disengagement that the stop screw 69 functions to keep the rocker lever down in close proximity with the valve so that when point H is reached, the rocker lever has not lifted which could damage the rocker lever or the closing cam as it resets itself at point H. The 230 degree camshaft position is illustrated in FIG. 28 and shows the rocker lever functioning as a second-class lever with the fulcrum at the valve stem. The positions of the parts corresponding to folloer reference point position H is shown in FIG. 29 where the camshaft is at 300 degrees. Thus, at the minimum speed of the engine, the opening cycle of the intake valve starts at top dead center (TDC) of the crankshaft (point A) and ends at 40 degrees beyond bottom dead center (BDC) and covers a 220 degree rotation of the crankshaft and a 110 degree rotation of the camshafts. Further, the opening camshaft is in fully retarded position, while the closing camshaft is in fully advanced position.

FIGS. 18, 19 and 20, respectively, show exhaust valve operation for minimum engine speed with a cam layout having the cam followers depicted in various positions to illustrate the opening and closing cycle, the valve open and lift graph data, and the valve timing diagram illustrating the relation between the exhaust valve open cycle and piston position. The exhaust valve remains closed through the intake and compression cycle and most of the power cycle and commences opening at the end of the power cycle and is open throughout the exhaust cycle. The intake valve is closed during the entire power and exhaust cycles.

At the 70 degree position of the camshafts and the exhaust valve cams 57*b* and 58*b*, the exhaust valve cam followers at reference point position C maintain the exhaust valve in closed position. Between the 90 degree and the 190 degree camshaft positions, the closing cam follower 65 disengages from the closing cam 58*b* until reference point position H is reached, while the opening cam follower 64 rides down the opening cam slope of cam 57*b*. The opening cycle of the exhaust valve commences at the 250 degree position of the camshafts, reference point position A, which in relation to the crankshaft position is the 500 degree position shown in FIG. 19. The closing cam follower thereafter continues to maintain its same position to reference point position E, while the opening cam follower moves along the lift of the opening cam 57*b* to the point near the full open position of the exhaust valve as shown by the lift position E, both in FIGS. 18 and 19. At the cam follower reference point position W the valve reaches its maximum lift position N with the cam follower 64 approaching the high dwell on cam 57*b*, and the cam follower 65 starting to move down the cam slope on closing cam 58*b*. At reference point position B cam follower 64 has reached its highest lobe position, while cam follower 65 has moved to a further lower position on the cam 58*b* to commence closing of the exhaust valve, and which closing is completed at reference position F or the 360 degree position of the camshafts and the 720 degree position of the crankshaft. As seen particularly in FIG. 20, the opening cycle of the exhaust valve commences 40 degrees ahead of piston bottom dead center at reference point position A and ends at top dead center at reference point position F. FIGS. 18 to 20 depict the operation of the exhaust valve at minimum engine speed, as does FIGS. 12 to 14 for the intake valve where the opening camshaft is in the fully retarded position and the closing camshaft is in the fully advanced position.

For a further understanding of the invention, corresponding cam timing diagrams, valve open duration and lift diagrams, and valve timing diagrams for the intake and exhaust valves during maximum speed of the engine are shown in FIGS. 15 to 17 and 21 to 23. It will be appreciated that between the minimum and maximum engine speeds, the timing of the valve opening and closing cycles, as well as the valve open duration and lift, will be adjusted to the speed between these outer parameters to give optimum engine performance.

As seen in FIGS. 15 to 17, during maximum speed the intake valve commences its opening cycle 40 degrees ahead of top dead center and closes at 80 degrees past bottom dead center, giving it a valve open duration of 300 degrees. The lift is maximum to position K (FIG. 16) and remains maximum for 10 degrees rotation of the camshafts and 20 degrees rotation of the crankshaft between reference point positions B and E (FIG. 15). During the period of maximum valve lift, the cam followers are on the high dwell of both cams where cam overlap occurs, resulting in no rocker lever motion and maintaining the valve open position for 10 degree camshaft travel and 20 degree crankshaft travel, thereby improving volumetric efficiency at high enging speed. Again, the full floating rocker lever makes the cam overlap possible. However, the system could be designed to eliminate cam overlap or to have it occur for whatever camshaft rotation desired, but it is preferable at higher speeds to obtain maximum volumetric efficiency, such as speeds of at least about 1000 RPM. The open duration of the intake valve covers a small part of the exhaust cycle, the entire intake cycle, and a part of the compression cycle from the 680 degree crankshaft position (A) to the 260 degree crankshaft position (F), and the 340 degree crankshaft position to the 130 degree camshaft position.

Similarly, for the exhaust valve at maximum speed, as seen in FIGS. 21 to 23, the valve open duration covers 300 degrees rotation of the crankshaft and the maximum lift is at position K and remains at that maximum lift point for 20 degrees rotation of the crankshaft and ten degrees rotation of the camshafts between positions B and E. The opening cycle of the exhaust valve at this maximum speed covers part of the power cycle, all of the exhaust cycle, and a small part of the intake cycle.

It will be appreciated that the foregoing principally relates to the automatic timing of the opening and closing cycles of the intake and exhaust valves in accordance with the speed of the engine during engine operation, although timing adjustment can be made when the engine is not running by manually moving lever 118 providing the accumulator 108*a* is charged.

Alternatively, the timing may be changed with a manual system, such as shown in FIGS. 9 and 10, wherein the belt carriage 87 is connected at the driving end by a threaded shaft 132 received in a threaded bore of an upstanding support 133 rigidly connected to the mounting plate 89. A knob 134 connected to the shaft facilitates rotation of the shaft relative to the support 133 to adjust the carriage position and valve timing. An indicator 135 carried by the carriage 87 coacts with a scale 136 on the support 133 to indicate the position of the carriage for reference purposes. A flexible drive shaft 137 is connected to the shaft 132 through the knob 134, and the opposite end may be extended to a remote location such as an operator's position and fitted with another hand knob and indicator for permitting adjustment of the timing. Accordingly, the manual adjusting system may be utilized where there is no need or desire to have the more complex speed responsive system for varying the timing of the valves and where engine speeds are not usually changing. While it is understood that valve timing may be adjusted when the engine is running or not, a manual control permits adjustment to provide optimum performance at a certain speed prior to starting the engine.

Figure 7:
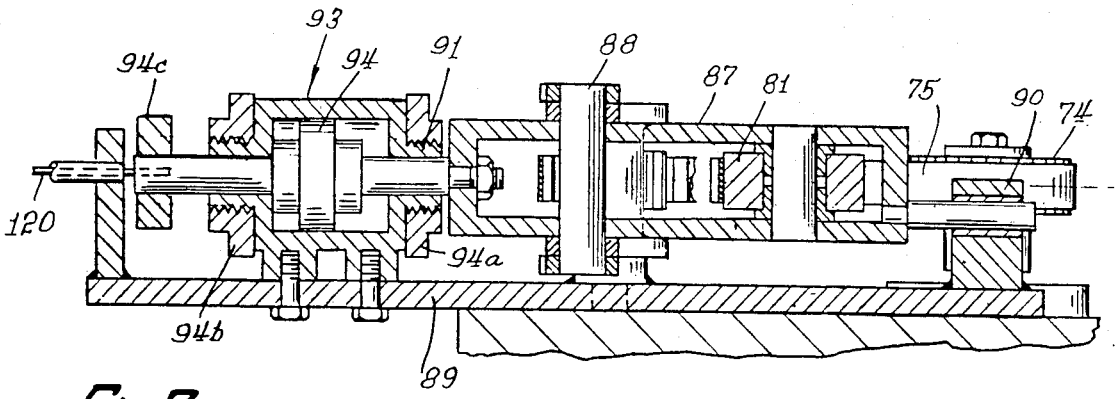
FIG. 7 is a detailed sectional view taken through the servomotor and the camshaft timing mechanism and taken generally along line 7—7 of FIG. 6.
Figure 8:
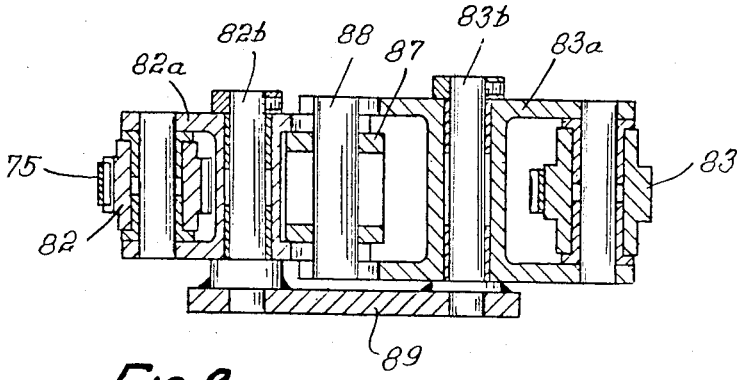
FIG. 8 is a detailed sectional view taken generally along line 8—8 of FIG. 6 and through the belt tensioning pulleys and yokes of the camshaft adjusting mechanism.

Referring to FIGS. 6 and 7, means for manually overriding the servomotor 93 in the event of its failure permits manual adjustment of the timing. Adjusting collars 94*a* and 94*b* are threadedly carried on the opposite ends of the servomotor housing, whereby running collar 94*a* against the carriage and moving it to a predetermined position and running collar 94*b* against collar 94*c* fixed to the shaft or servo piston 94 locks the carriage in a chosen position.

The application of the invention to a two-stroke compression ignition engine having a poppet-type exhaust valve is schematically illustrated in FIG. 30, wherein the mechanism for adjusting the timing of the opening and closing of the exhaust valve 140 to piston and crankshaft position is of the same type as illustrated with the four-cycle engine shown in FIGS. 1 to 3. However, because of two-cycle operation, the camshafts are driven at the same speed as the crankshaft. As in the four-cycle engine, since the timing is adjustable manually or automatically for all speeds by any of the systems above described, optimum performance is achieved at all speeds, even though only the exhaust cycle is adjustable.

It should further be recognized that camshaft operation could be reversed where the opening cam can be changed to the closing cam and the closing cam changed to the opening cam with respective changes in camshaft timing to suit the function shown in FIGS. 12 to 23.

It will be understood that modifications and variations may be effected without departing from the scope of the novel concepts of the present invention, but it is understood that this application is to be limited only by the scope of the appended claims.

The invention is hereby claimed as follows:

1. In an internal combustion engine of the four-cycle spark or compression ignition type or the two-cycle compression ignition type having at least one cylinder with a piston reciprocable therein and connected to a crankshaft, a combustion chamber at one end of the cylinder coacting with the piston, at least one poppet-type valve for said combustion chamber, and a valve return spring continually biasing said valve into closed position, the improvement being in means for controlling the operation of said valve through opening and closing cycles in timed relation to the crankshaft and for adjusting the timed relation which comprises, a floating valve operating rocker lever means in driving relation to said valve, said lever means having first and second cam followers, means restricting the lateral and longitudinal movement of said lever means, first and second camshafts driven from said crankshaft and having first and second cams for applying forces to said first and second cam followers, and drive means between both said camshafts and said crankshaft having means for adjusting said timed relation so that optimum performance may be achieved for any engine speed.

2. The improvement defined in claim 1, wherein said camshafts and cams are disposed to provide cam underlap at minimum engine speeds to enhance combustion.

3. The improvement defined in claim 1, wherein said camshafts and cams are disposed to provide cam overlap at engine speeds of about 1000 RPM and above to enhance volumetric efficiency.

4. The improvement defined in claim 1, wherein said camshafts and cams are disposed to provide cam underlap at minimum engine speeds to enhance combustion and cam overlap at engine speeds of about 1000 RPM and above to enhance volumetric efficiency.

5. The improvement defined in claim 1, wherein for a four-cycle engine, the camshafts are driven at one-half crankshaft speed.

6. The improvement defined in claim 1, wherein for a two-cycle engine, the camshafts are driven at crankshaft speed.

7. The improvement defined in claim 1, wherein said drive means for adjusting timing of said valves is responsive to changes in operating speed of said engine to provide optimum timing for each given speed, said means for adjusting timing comprising servomotor means, means connecting said speed measuring means with said servomotor means for activate the latter upon change in the speed of said engine, and means connecting said servomotor means with said means for opening and closing said valves to adjust said timing of opening and closing of said valves to optimum timing at each given speed.

8. In a four-cycle internal combustion engine having at least one combustion chamber with a piston connected to a crankshaft, and poppet-type intake and exhaust valves for controlling the flow of gases to and from said combustion chamber, the improvement being in means for controlling the timing of the opening and closing of said valves in relation to piston and crankshaft position which comprises, a floating rocker lever for each of said valves and in driving relation therewith, means guiding the lateral and longitudinal movement of said levers, each rocker lever having one end drivingly associated with a valve and having a first cam follower at the other end and a second cam follower intermediate the ends, first and second camshafts respectively having first and second cams for controlling the positions of said first and second cam followers, and means between the crankshaft and camshafts for driving the camshafts in timed relation to the crankshaft and for adjusting the timing of the camshafts to thereby adjust the timing of the opening and closing of said valves with respect to the crankshaft and obtain optimum efficiency at any given speed.

9. The improvement defined in claim 8, wherein said timing adjusting means includes a manually settable means.

10. The improvement defined in claim 8, wherein said timing adjusting means includes automatic means responding to the engine speed.

11. In a four-cycle internal combustion engine having an engine block with a cylinder therein, a piston in the cylinder, a crankshaft mounted in said block, means connecting the piston and crankshaft, a cylinder head mounted on the block and coacting with the cylinder to define a combustion chamber, and poppet-type intake and exhaust valves mounted in the head for controlling the flow of gases to and from the combustion chamber, the improvement being in means for opening and closing said valves and setting the timing relation between the valves and the piston and crankshaft positions which comprises, first and second camshafts in said head driven from said crankshaft, rocker levers for each of said valves, means controlling the lateral and longitudinal movement of the levers, one end of each lever being drivingly connected to a valve, a cam follower at the other end of each lever engaging a cam on one of said camshafts, a cam follower intermediate the ends of each lever engagable with a cam on the other of said camshafts, and adjustable drive means between the crankshaft and said camshafts for constantly driving said camshafts at one half the speed of the crankshaft and for adjustably setting the timing relation of the valves to obtain optimum engine performance.

12. The improvement defined in claim 11, wherein said adjustable drive means includes an endless timing member drivingly connected to said camshafts and said crankshaft, and means for advancing and retarding the angular relationship between the crankshaft and the camshafts.

13. The improvement defined in claim 12, wherein said advancing and retarding means includes a plurality of rotatable takeup guide members over which the endless timing member is trained and means for moving the guide members in unison.

14. The improvement defined in claim 11, wherein said moving means includes manually settable means.

15. The improvement defined in claim 11, wherein said moving means includes a servomotor and a speed responsive device drivingly connected to a camshaft for controlling operation of said servomotor.

16. In a four-cycle internal combustion engine having an engine block with a cylinder therein, a piston in the cylinder, a crankshaft mounted in said block, means connecting the piston and crankshaft, a cylinder head mounted on the block and coacting with the cylinder to define a combustion chamber, and poppet-type intake and exhaust valves mounted in the head for controlling the flow of gases to and from the combustion chamber, the improvement being in means for opening and closing said valves and setting the timing relation between the valves and the piston and crankshaft which comprises, a valve opening camshaft and a valve closing camshaft, a floating rocker lever for each of said valves, means restricting the lateral and longitudinal movement of said levers, one end of each lever drivingly connected to a respective valve, a cam follower on the other end of each lever in alignment with said opening camshaft and in engagement with cams thereon, a cam follower intermediate the ends of each of said levers in alignment with said closing camshaft and engageable with cams thereon, pulleys on the ends of said camshafts, a crankshaft speed reducing drive having an output pulley, a timing belt over said camshaft pulleys and said output pulley, movable timing and takeup pulleys guiding the belt between said camshafts and output pulley for selectively advancing or retarding the timing relation between the valves and the crankshaft so that optimum engine efficiency can be achieved at any engine speed, and means for moving said timing and takeup pulleys.

17. The improvement defined in claim 16, which further includes manual means for resetting the movable timing and takeup pulleys.

18. The improvement defined in claim 16, which further includes automatic means for resetting the movable timing and takeup pulleys in response to engine speed.

19. The improvement defined in claim 16, which further includes a speed responsive mechanism driven by the engine and a servomotor operably controlled by said mechanism and drivingly connected to said movable timing and takeup pulleys.

20. The improvement defined in claim 16, which further includes means for indicating the engine speed.

21. A four-cycle internal combustion engine comprising, an engine block with a cylinder therein, a piston in the cylinder, a crankshaft mounted in said block, means connecting the piston and crankshaft, a cylinder head mounted on the block and coacting with the cylinder to define a combustion chamber, poppet-type intake and exhaust valves mounted in the head for controlling the flow of gases to and from the combustion chamber, a rocker lever for each of said valves, each lever being drivingly connected at one end to a valve and having a first cam follower at the other end and a second cam follower intermediate the ends, first and second camshafts driven by said crankshaft and respectively having cams for engagement with said first and second cam followers, and an adjustable timing mechanism drivingly interconnecting said crankshaft and said camshafts for simultaneously changing the opening and closing cycles of said valves relative to engine speed to obtain optimum engine efficiency at any given speed.

22. The combination of claim 21, which further comprises a manually settable device for operating said adjustable timing mechanism.

23. The combination of claim 21, which further comprises means responsive to engine speed for automatically operating said adjustable timing mechanism.

* * * * *